United States Patent [19]

Tipton

[11] 4,248,026

[45] Feb. 3, 1981

[54] TROLLEY FOR INSTALLING PREFABRICATED BUILDING PANELS

[76] Inventor: James A. Tipton, 1243 Browns Ferry Rd., Chattanooga, Tenn. 37419

[21] Appl. No.: 53,745

[22] Filed: Jul. 2, 1979

[51] Int. Cl.[3] ..... F04D 15/00

[52] U.S. Cl. ..... 52/749; 182/45

[58] Field of Search ..... 52/747, 748, 749; 182/45, 36, 38; 105/86, 142, 141, 157; 86/27.5

[56] References Cited

U.S. PATENT DOCUMENTS

| | | | |
|---|---|---|---|
| 696,535 | 4/1902 | Bailey | 182/45 X |
| 4,068,446 | 1/1978 | Brueske | 182/45 X |

*Primary Examiner*—Price C. Faw, Jr.
*Assistant Examiner*—Carl D. Friedman
*Attorney, Agent, or Firm*—Alan Ruderman

[57] ABSTRACT

A trolley for aiding in the installation of sidewall panels to the eave struts and purlins of prefabricated metal buildings. The trolley has a seat support member with foot stirrups for carrying a workman and a pair of wheel carrying brackets secured to opposite sides of the support member. The wheels are carried on and roll over the horizontal portions of an eave strut and adjacent purlin. The support member and one of the brackets are adjustable for variations in the design dimensions of prefabricated buildings.

6 Claims, 4 Drawing Figures

TROLLEY FOR INSTALLING PREFABRICATED BUILDING PANELS

BACKGROUND OF THE INVENTION

This invention relates to a construction aid for erecting prefabricated metal buildings and more particularly to a trolley for rolling along the roof panel supports and carrying a workman installing the wall panels and the roof insulation.

In the erection of prefabricated metal buildings after the vertical column frame members are erected and the rafters are installed, a series of support members extending the length of the building are secured across the rafters for carrying the roof panel sheets which are attached thereto. These support members are known as eave struts and purlins depending on their placement and function. The eave struts are at the end of the sides of the building and the purlins are between the eave struts; both include ledge portions for rigidity.

After the eave struts and purlins are installed the sheet metal sidewall panels are attached to the eave struts, the roof insulation installed and the sheet metal roof panels are attached to the eave struts and purlins. Conventionally, the sidewall panels and the roof insulation are installed by at least two workers supported on scaffolding. The scaffolding must be assembled and moved as the workers progress about the building. As with all scaffolding, the set up time and moving time is substantial and non-productive, and thus adds to the cost of erecting a building.

SUMMARY OF THE INVENTION

The present invention provides a simple device for installing the sidewall panels and roof insulation of prefabricated metal buildings by eliminating the scaffolding for these assembling operations. The device is a trolley having wheels that rest on and roll along the ledges of the eave strut and the adjacent purlin. A seat is provided for a worker to sit upon and stirrups support the worker's feet as he faces the eave strut and thus the sidewalls. The seat support member is adjustable longitudinally, and the vertical position of the wheels that rest on the purlin is adjustable relatively to those that rest on the eave struts. In installing the sidewall panels and the roof insulation a worker sitting on the trolley can propel himself from one end of the building to the other and has his hands free for positioning the panels or securing them.

Consequently, it is a primary object of the present invention to provide a trolley for aiding in the erection of the sidewall panels and the roof insulation of prefabricated metal buildings.

It is another object of the present invention to provide a trolley on which a worker can sit and propel himself between an eave strut and a purlin of a prefabricated metal building.

It is a further object of this invention to provide a trolley having rolling wheels supportable between an eave strut and a purlin of a prefabricated metal building structure and includes a seat for carrying a workman.

It is a still further object of the present invention to provide a trolley having a seat supporting member carrying supports for the feet of a workman secured to roller carrying members, the rollers being positionable between and supportable on an eave strut and adjacent purlin in a prefabricated metal building structure, the relative vertical position and span between the rollers being adjustable for various building designs.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMOBODIMENT

Figure 1:
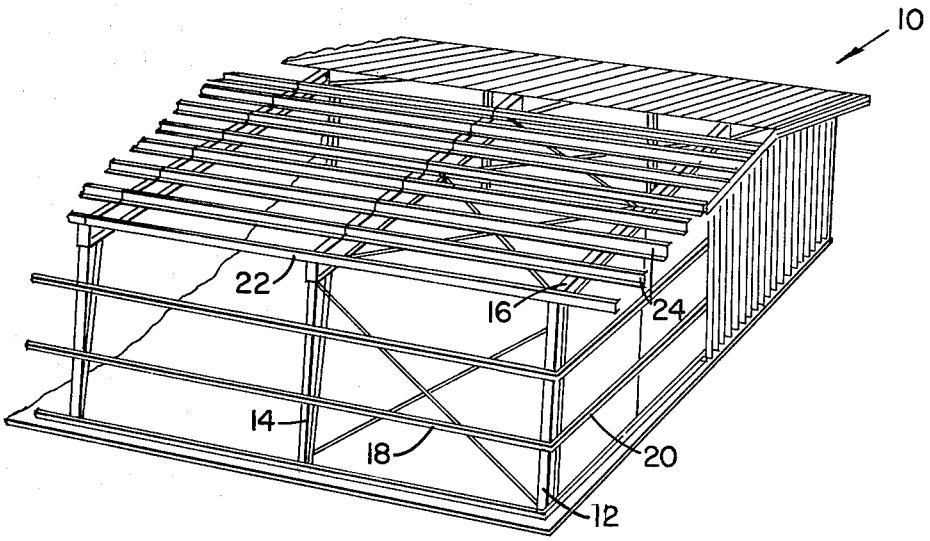
FIG. 1 is a fragmentary perspective view of a typical prefabricated metal building illustrating a portion of the underlying structual elements.
Figure 2:
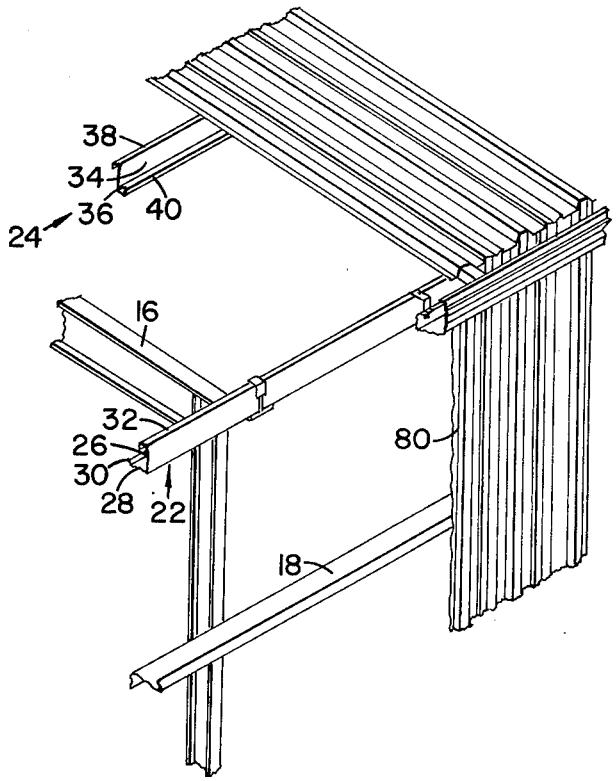
FIG. 2 is a perspective view of a small section of the building of FIG. 1.

Referring to the drawings FIGS. 1 and 2 illustrate a portion of a typical prefabricated metal building 10 having vertical corner column 12 and intermediate vertical frame columns 14. The columns carry the rafters 16 and support sidewall and endwall girts 18 and 20 respectively securred thereto. Eave struts 22, extending in sections the length of the building are secured across the rafters as are purlins 24. The spacing between the eave struts and adjacent purlins, and between adjacent purlins varies between approximately three and five feet depending on the known designs of the various manufacturers.

The eave struts 22 are each substantially L-shaped in cross section having a vertically disposed web 26 and a horizontally disposed ledge 28 at the lower end of the web including a slightly upturned lip 30. It may also include another horizontally disposed ledge 32 at the upper end of the web 26 overlying but shorter than ledge 28. The purlins 24 are of a substantially inverted Z configuration having a central vertically disposed web 34 at each end of which a horizontally disposed ledge 36 and 38 respectively extends. The lower ledge 36 faces in the direction toward the adjacent eave strut 22 and includes an upturned lip 40. The particular shapes of the eave struts and purlins provide structual strength and rigidity and are conventional.

The trolley 42 of the present invention comprises a support bar preferably formed of two tube sections 44 and 46. The section 44 has an outer diameter slightly smaller than the inner diameter of the section 46 and is telescopically received therein. A locking bolt 48 tapped into the tube section 46 can be tightened to secure the tubes together in an adjusted position to allow use of the trolley with buildings having variations in the spacing between the eave strut and purlin. Secured to the section 46 by conventional means is a seat 50 facing toward a pair of stirrups 52,54, each of which has a securing member 56 fixed to the tube section 46, and a foot receiving rest member 58.

Figure 3:
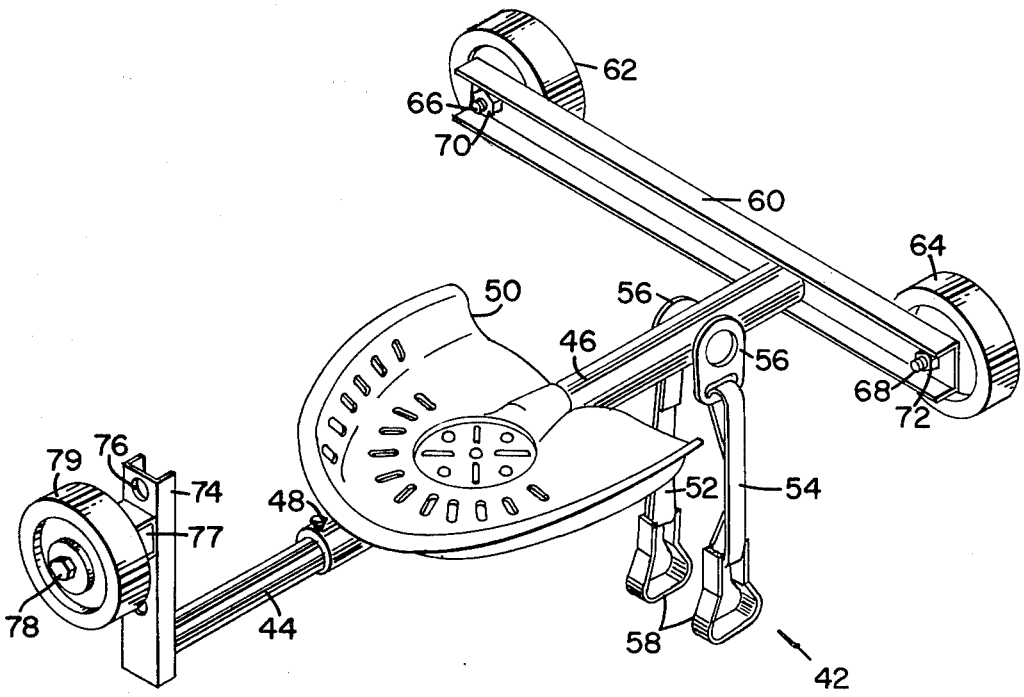
FIG. 3 is a perspective view of a trolley constructed in accordance with the principles of the present invention.

Fixed to the support bar section 46 substantially perpendicular thereto is a bracket 60 which preferably is of a high strength and light weight configuration such as a U-shaped channel beam as illustrated in FIG. 3. A roller or wheel 62 and 64 is carried by the bracket 60 adjacent each end thereof, the wheels being a conventional type supported on axles 66 and 68 by roller bearings (not illustrated) and the axles in turn are secured to the bracket 60 by conventional means such as nuts 70 and 72.

The support bar section 44 like-wise carries a wheel carrying hanger 74 of a U-shaped sectional configuration which is fixed to the section 44 substantially perpendicularly and extends upwardly relatively to the section 44 and seat 50. The hangar 74 has a plurality of holes 76 for selectively receiving a securing stud 75 of a yoke member 77 in which the axle 78 of a wheel 79 similar to the wheels 62 and 64 is mounted.

Figure 4:
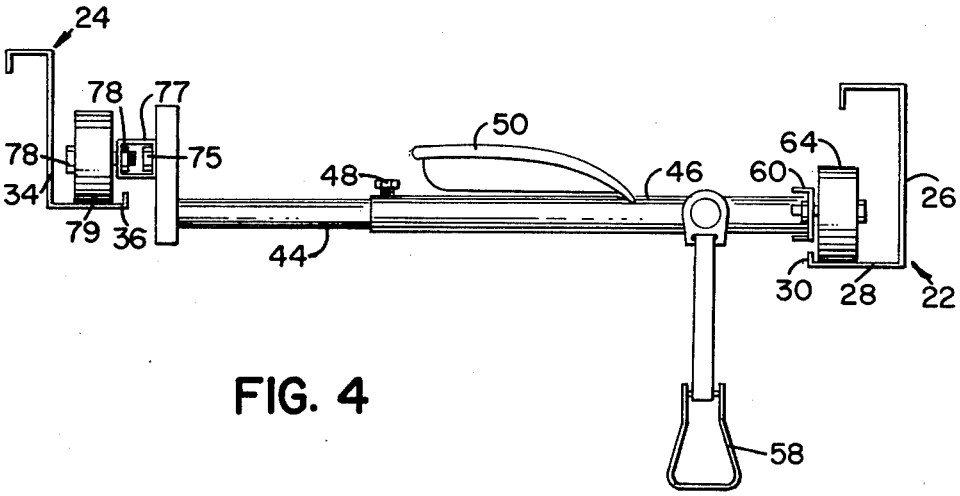
FIG. 4 is an elevational view of the trolley in operational position on an eave strut and purlin of the building of FIG. 1.

Referring now to FIG. 4, it should be clear that the wheels 62 and 64 are positioned and supported on the ledge 28 of the eave strut 22 while the wheel 78 is similarly carried by the ledge 36 of the purlin 24. The wheel 78 can be adjusted vertically along the hangar 74 by means of the holes 76 so that the trolley is substantially horizontally disposed. This adjustment is in the range of approximately zero to ten inches depending on the pitch of the roof of the building under construction. For a normal one inch in twelve pitch the wheel 78 will be approximately four inches above the wheels 62 and 64. The sections 44 and 46 are adjusted relatively to each other so the wheels 62,64 and 78 are all properly positioned. A workman sitting on the seat 50 with his feet in the stirrup rests 58 will then be facing the eave struts. He has his hands free for positioning a sidewall panel 80 and subsequently for positioning roof insulation (not illustrated). Another workman on a similar trolley can follow behind and secure the positioned member by drilling and fastening it to the eave strut. The workmen can propel themselves across the length of the building to other stations by pushing off manually on the eave strut as they finish securing each member. The trolley rolls over the rafters and the workers merely lift the foot stirrups as they cross each rafter.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A trolley for aiding in the installation of sidewall panels of prefabricated metal buildings having a longitudinally extending eave strut and a purlin including laterally facing substantially horizontally disposed ledges, said trolley comprising a frame including a laterally extending support, a bracket secured to one end of the support and a hanger secured to the other end of the support, first wheel means rotatably carried by said bracket for rolling on said ledge of the eave strut, second wheel means rotatably carried by said hanger for rolling on said ledge of the purlin, a seat secured to said support for carrying a workperson facing said bracket, and foot support means straddling said support intermediate said seat and said first wheel means for supporting the feet of the workperson while on said seat, whereby the workperson may propel the trolley longitudinally between the eave strut and the purlin to install said panels.

2. A trolley as recited in claim 1 wherein said support comprises first and second members, and means for adjustably securing said members laterally for changing the relative lateral disposition of said first and second wheel means.

3. A trolley as recited in claim 1 wherein said hanger includes means for varying the vertical position of the second wheel means relatively to said first wheel means.

4. A trolley as recited in claim 1 wherein said foot support means comprises a pair of stirrups.

5. A trolley as recited in claim 1 wherein said first wheel means comprises a pair of wheels spaced apart in the direction of the eave strut and said second wheel means comprises a single wheel.

6. A trolley for aiding in the installation of sidewall panels of prefabricated metal buildings having a longitudinally extending eave strut and a purlin including laterally facing substantially horizontally disposed ledges, said trolley comprising a frame including a laterally extending support, said support comprising first and second members, means for telescopically receiving one end of said first member within one end of said second member, means for securing said first and second members together, a bracket secured to the other end of one of said members and a hanger secured to the other end of the other of said members, first wheel means rotatably carried by said bracket for rolling on said ledge of the eave strut, second wheel means rotatably carried by said hanger for rolling on said ledge of the purlin, a seat secured to one of said members for carrying a workperson facing said bracket, and foot support means intermediate said seat and said first wheel means for supporting the feet of a workperson, whereby the workperson may propel the trolley longitudinally between the eave strut and the purlin to install said panels.

* * * * *